United States Patent [19]

Heitmann

[11] Patent Number: 4,729,386

[45] Date of Patent: Mar. 8, 1988

[54] APPARATUS FOR MAKING CIGARETTES WITH DENSE ENDS

[75] Inventor: Uwe Heitmann, Hamburg, Fed. Rep. of Germany

[73] Assignee: Körber AG, Hamburg, Fed. Rep. of Germany

[21] Appl. No.: 899,348

[22] Filed: Aug. 22, 1986

[30] Foreign Application Priority Data

Aug. 22, 1985 [DE] Fed. Rep. of Germany ..... 3530027

[51] Int. Cl.[4] ..... A24C 5/18

[52] U.S. Cl. ..... 131/84.1; 131/84.3; 131/84.4; 131/61.1

[58] Field of Search ..... 131/84.1, 84.3, 84.4, 131/61.1, 84.2, 88

[56] References Cited

U.S. PATENT DOCUMENTS

| | | | |
|---|---|---|---|
| 3,306,305 | 2/1967 | Molins | 131/61.1 |
| 3,318,314 | 5/1967 | Stelzer | 131/84.4 |
| 3,413,979 | 12/1968 | Korber | 131/84.3 |
| 3,608,562 | 9/1971 | Gormann | 131/84.4 |
| 3,731,693 | 5/1973 | Pocock | 131/84.3 |
| 3,841,337 | 10/1974 | Varner | 131/84.3 |
| 4,037,608 | 7/1977 | Wahle | 131/84.4 |
| 4,485,826 | 12/1984 | Holzangel | 131/84.1 |
| 4,589,426 | 5/1986 | Mattei | 131/84.4 |

*Primary Examiner*—V. Millin

*Attorney, Agent, or Firm*—Peter K. Kontler

[57] ABSTRACT

A cigarette rod making machine wherein a shower of tobacco particles is attracted to the underside of the straight horizontal lower reach of an endless air-permeable conveyor which advances the fully grown stream through a surplus removing station before the stream enters the wrapping mechanism wherein it is draped into a web of cigarette paper. Spaced-apart portions of the stream are pneumatically densified at the surplus removing station by attracting the fibrous material against the lower reach of the conveyor or in another direction so as to reduce the quantity of the removed surplus. This can be achieved by utilizing one or more rotary valving elements which connect the corresponding portion of the path for the stream with one or more suction chambers so as to effect a more pronounced densification of the corresponding portions of the stream.

25 Claims, 14 Drawing Figures

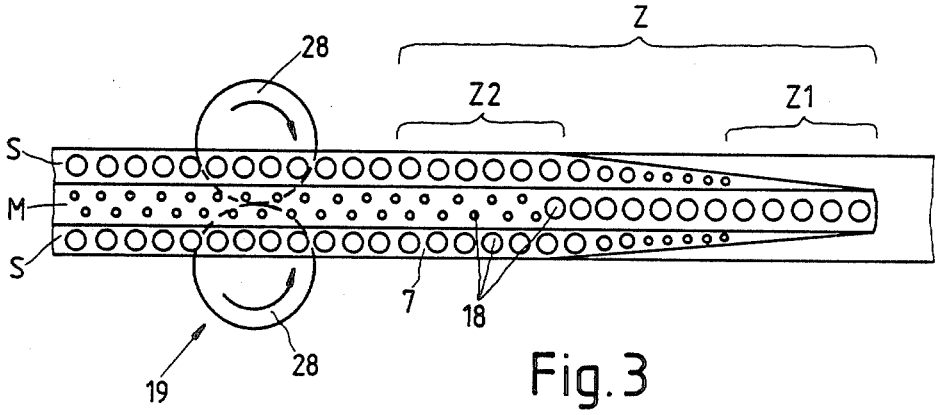
Fig. 3
Fig. 4
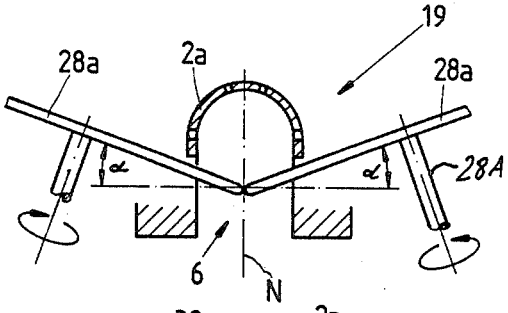
Fig. 5
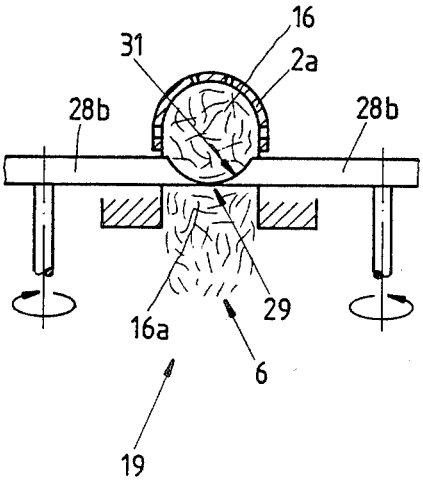
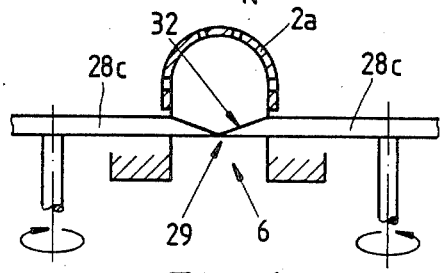
Fig. 6

APPARATUS FOR MAKING CIGARETTES WITH DENSE ENDS

CROSS-REFERENCE TO RELATED CASE

The apparatus which is shown in FIGS. 1-9 of the present application is identical with that which is disclosed in the commonly owned copending patent application Ser. No. 899,349 filed Aug. 22, 1986.

BACKGROUND OF THE INVENTION

The present invention relates to apparatus for making cigarettes or analogous rod-shaped articles of the tobacco processing industry, and more particularly to improvements in the making of cigarettes, cigars or cigarillos with so-called dense ends. The following description of the invention will deal primarily with the making of cigarettes but the same procedure can be followed in connection with the making of other rod-shaped articles of the tobacco processing industry. Such articles are intended to embrace those which contain smokable material as well as those which contain filter material for tobacco smoke.

Cigarettes are made in so-called rod making machines wherein a continuous shower of fibrous material (such as particles of natural tobacco leaves, fragments of sheets of reconstituted tobacco and/or fragments of substitute tobacco) is attracted to one side of an air-permeable belt conveyor which accumulates a continuous stream containing a surplus of fibrous material. The surplus is removed by a trimming or equalizing device, and the resulting trimmed stream or filler is thereupon draped into a continuous web of cigarette paper or other suitable wrapping material to form therewith a continuous cigarette rod which is subdivided into sections of unit length or multiple unit length. Such sections can be admitted into a filter tipping machine, into a packing machine or to storage. A suction chamber at the other side of the air-permeable conveyor attracts the shower of fibrous material and thereupon the built up stream during travel toward, past and beyond the surplus removing station.

It is already known to densify longitudinally spaced-apart portions of the continuous stream so as to establish zones of greater density. If the cigarette rod is severed across or adjacent such zones of greater density, each of the thus obtained cigarettes will have one or two dense ends. The purpose of densifying one or both ends of each cigarette is to reduce the likelihood of escape of fragments of tobacco.

Densification of selected portions of a continuous stream of tobacco or similar fibrous material is normally effected by removing less tobacco from those portions of the stream which are to constitute the filler portions at the ends of cigarettes. In accordance with a presently known proposal, the removal of surplus at the trimming station is regulated by employing specially designed trimming discs the peripheries of which are provided with pockets so that the discs remove more tobacco from spaced-apart first portions of the advancing stream and less tobacco from second portions of the same stream which alternate with the first portions.

In accordance with a different proposal which is disclosed in British Pat. No. 948,736, the conveyor for the continuous tobacco stream is a circulating wheel with a circumferential groove in which the stream advances past the trimming station. The groove is adjacent a suction chamber including portions which attract the fibrous material with a greater force in those regions where the cigarette ends should contain more tobacco. A similar apparatus is disclosed in U.S. Pat. No. 3,306,305 which describes an apparatus employing an air-permeable conveyor in the form of a metallic band having openings for the passage of air streams. The combined cross-sectional area of openings in first sections of the band deviates from the combined cross sectional area of openings in second sections which alternate with the first sections. This enables the conveyor to attract different portions of the stream with a different force and such treatment of tobacco also results in the making of a stream which is ready for conversion into the filler of a cigarette rod capable of being subdivided into cigarettes with dense ends.

A drawback of the patented apparatus is that the stream is likely to slip relative to the wheel-shaped or metallic band-like conveyor with the resulting displacement of densified zones. Another drawback of the patented apparatus is that a different wheel and a different steel band is necessary for each type of cigarettes, namely for shorter, medium long and longer cigarettes. Consequently, each change of setup takes up a substantial amount of time and the machine utilizing such apparatus must be furnished with a number of spare conveyors.

OBJECTS AND SUMMARY OF THE INVENTION

An object of the invention is to provide a novel and improved apparatus for making a continuous stream of smokable fibrous material for the making of cigarettes or the like or fibrous filter material for the making of filters for tobacco smoke, and to construct and assemble the apparatus in such a way that it can provide selected portions of the stream with predictably densified regions.

Another object of the invention is to provide a novel and improved rod making machine which embodies the above outlined apparatus.

A further object of the invention is to provide a novel and improved method of densifying the ends of cigarettes and analogous articles of the tobacco processing industry.

An additional object of the invention is to provide the apparatus with novel and improved means for densifying selected portions of a continuous stream of fibrous material.

Still another object of the invention is to provide the apparatus with novel and improved means for reducing the tendency of the continuous stream to move relative to its conveyor means and/or vice versa.

Another object of the invention is to provide novel and improved means for guiding and confining the stream of fibrous material between the stream forming zone and the zone where the stream is draped into a web of cigarette paper or other suitable wrapping material.

A further object of the invention is to provide an apparatus which can be installed in existing cigarette rod making and like machines as a superior substitute for heretofore known and used apparatus.

Another object of the invention is to provide a tobacco densifying device which can be utilized in a rod making machine to densify selected portions of a continuous stream of fibrous material at any desired distance from each other.

A further object of the invention is to provide a cigarette rod making machine which can be converted for the making of different types of cigarettes with minimal losses of time.

The invention is embodied in an apparatus for making a continuous stream from fibrous material of the tobacco processing industry. The apparatus comprises an endless conveyor which defines an elongated path, means for feeding fibrous material into a first portion of the path so as to build a continuous stream which contains a surplus of fibrous material and advances along the path, means for removing the surplus from the stream in a second portion of the path downstream of the first portion, and means for pneumatically densifying spaced-apart portions of the stream in the region of the surplus removing means. The conveyor is preferably permeable to air and has a first side adjacent the elongated path and a second side facing away from the first side. In accordance with a presently preferred embodiment of the invention, the densifying means includes means for establishing a variable pressure differential between the first and second sides of the conveyor so as to attract the stream to the first side and to densify the stream in the path, and means for periodically varying the pressure differential so as to change the extent of densification of the stream in the aforementioned region. The varying means can comprise a control member which serves to periodically increase the pressure differential at least in the second portion of the elongated path. The means which establishes the pressure differential can include at least one suction chamber which is adjacent the second side of the air-permeable conveyor, a first suction generating device which serves to maintain the pressure in the suction chamber at a first value, and a second suction generating device which serves to maintain the pressure in the suction chamber at a lower second value. The aforementioned means for varying the pressure differential includes means for alternately connecting the suction chamber with the first and second suction generating devices. The suction chamber is adjacent the second portion of the path, and the means for establishing the pressure differential can further comprise a second suction chamber which is connected to the first suction generating device and includes first and second portions which are adjacent the second side of the conveyor and are respectively disposed upstream and downstream of the second portion of the path. The means for varying the pressure differential in such apparatus can include means for alternatingly connecting the at least one suction chamber with the second suction chamber and with the second suction generating device. The means for establishing the pressure differential can comprise a plurality of suction chambers which are adjacent the second side of the conveyor in the region of the second portion of the elongated path. The densifying means of such apparatus preferably further comprises a housing for the means which varies the pressure differential and for the plurality of suction chambers. The housing is provided with a pair of passages for each of the plurality of suction chambers, and the means for varying the pressure differential in such apparatus can comprise a valving element which is rotatably mounted in the housing and has means (such as a circumferentially extending groove) for connecting successive suction chambers with one passage of each pair of passages during a first stage of each revolution of the valving element, and means (such as radially and axially extending bores in the valving element) for connecting the second suction generating device with the other passage of each pair of passages during a second stage of each revolution of the valving element. Means is provided to drive the conveyor and the valving element so that the peripheral speed of the valving element equals or approximates the speed of the conveyor.

In accordance with another presently preferred embodiment of the invention, the apparatus further comprises a channel for the conveyor and such channel has sidewalls which flank the second portion of the path. The densifying means of such apparatus can comprise a suction chamber which is provided in at least one of the sidewalls and mobile valve means provided in the one sidewall and serving to intermittently connect the suction chamber with the second portion of the path so as to effect a densification of the stream in the second portion of the path by means of air which flows into the suction chamber. The valve means of such apparatus has openings which are preferably oriented in such a way that currents of air flowing from the second portion of the path into the suction chamber urge the stream of fibrous material in the second portion of the path to bear upon the endless conveyor while the stream advances with the conveyor. The valve means can include a rotor and the openings are preferably disposed in a predetermined portion of the rotor. It is preferred to provide a suction chamber in each of the two sidewalls and to provide each sidewall with discrete mobile valve means.

The apparatus embodying the aforediscussed densifying means preferably further comprises means for converting the stream into a rod-like filler having a predetermined outline in a third portion of the elongated path. As mentioned above, the conveyor is preferably permeable to air and such conveyor includes a median section having an outline which is substantially complementary to a portion of the predetermined outline of the filler and two lateral sections which flank the median section. The means for attracting fibrous material to the conveyor in the first portion of the path preferably includes means for attracting fibrous material to the median section in a first or upstream region of the first portion of the elongated path, and means for attracting fibrous material to the median section as well as to the lateral sections in a second region of the first portion of the elongated path downstream of the first or upstream region. In addition to or instead of shaping or molding a portion of the stream so as to conform to the corresponding portion of the filler by resorting to a suitably configurated conveyor, the surplus removing means can be designed in such a way that it imparts to a selected portion of the stream an outline which at least approximates a portion of the predetermined outline of the filler.

The channel for the conveyor can have a substantially U-shaped cross-sectional outline so as to promote the formation of a stream a portion of which has a shape matching or resembling the cross-sectional outline of the corresponding portion of the filler.

A highly satisfactory densifying action an be achieved if the densifying means comprises at least one rotary element (such as the aforementioned valve means or valving element) and means for driving the rotary element at different speeds during predetermined stages of each revolution of the rotary element. The densifying means can be provided with means for urging selected portions of the stream against the air-permeable conveyor and/or against the one and/or the other sidewall of the channel for the conveyor. As mentioned above, the urging means can comprise one or more stationary suction chambers which are adjacent the second portion of the elongated path and the rotary element can have one or more orbiting suction ports (openings) which serve to periodically connect the suction chamber or chambers with the second portion of the path so that the current or currents of air which are induced by suction can act upon and densify selected portions of the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a developed bottom plan view of the structure at the stream building station;

FIG. 4 is a transverse sectional view of a modified apparatus using a different surplus removing device;

FIG. 5 is a similar transverse sectional view showing a further surplus removing device;

FIG. 6 is a similar sectional view showing an additional surplus removing device;

DESCRIPTION OF THE PREFERRED EMBODIMENTS

Figure 1:
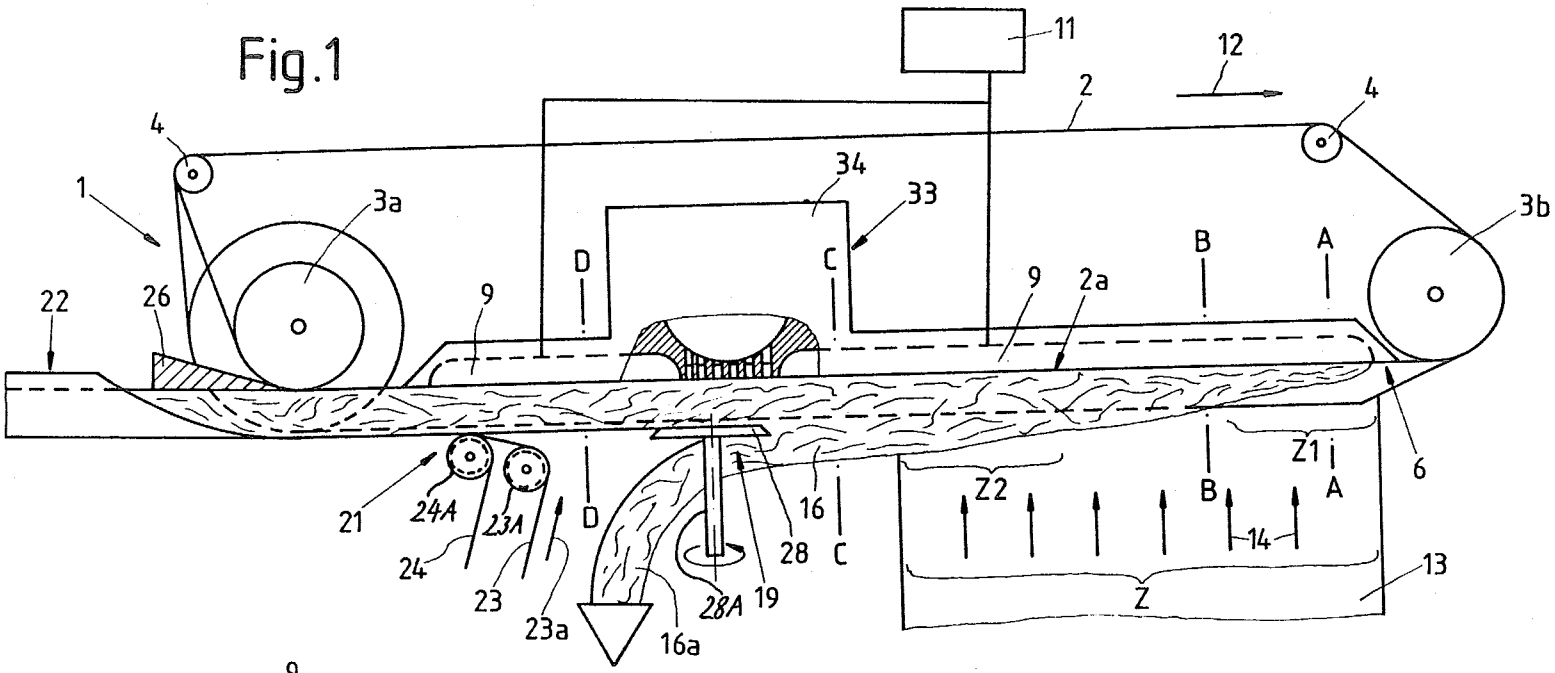
FIG. 1 is a fragmentary schematic partly elevational and partly sectional view of an apparatus which embodies one form of the invention.

FIG. 1 shows a portion of a cigarette rod making machine which embodies one form of the improved apparatus for making cigarettes with dense ends. The apparatus comprises a transporting unit 1 having an endless air-permeable belt conveyor 2 which is trained over a front pulley 3*a*, a rear pulley 3*b* and a pair of deflecting rollers 4. The pulley 3*a* and/or 3*b* is driven to advance the conveyor 2 in the direction which is indicated by arrow 12. The lower reach 2*a* of the conveyor 2 has an underside which is adjacent an elongated straight horizontal path for a continuous stream 16 of tobacco particles. The cigarette making machine which embodies the apparatus of the present invention can be of the type known as PROTOS which is manufactured by the assignee of the present application. The conveyor 2 can constitute a perforated metallic or plastic band or a foraminous textile band. The lower reach 2*a* of the conveyor 2 travels between the sidewalls 6*a* of an inverted U-shaped tobacco channel 6 which defines a plurality of suction chambers including those numbered 9 and 17. The bottom wall 7 of the channel 6 has an arcuate shape with the concave side facing the upper side of the lower reach 2*a*. The curvature of the bottom wall 7 is preferably such that a portion of the stream 16 at the concave side of the lower reach 2*a* is imparted a cross-sectional outline corresponding to that of the respective portion of the filler of the finished cigarette rod which is obtained from the stream 16 and from a continuous web 23 of cigarette paper or other suitable wrapping material during travel through a wrapping mechanism 22 of conventional design. The upper portion 8 of the channel 6 is secured to the frame of the cigarette rod making machine.

The means for feeding loose fibrous material into an upstream region Z1 of the first or upstream portion Z (stream building zone) of the elongated path at the underside of the lower reach 2*a* of the conveyor 2 comprises an upwardly extending duct 13 wherein the fibrous material forms a shower whose particles advance in the directions indicated by arrows 14. The duct 13 forms part of the distributor (also called hopper) in the cigarette rod making machine. The fully grown tobacco stream 16 contains a surplus (16*a*) of fibrous material and advances from the first path portion Z toward and into a second portion of the path where it is acted upon by a surplus removing or trimming device 19. The suction chamber 9 in the channel 6 is connected with a suitable suction generating device 11 (e.g., a suction fan) which enables the suction chamber 9 to establish a pressure differential between the upper side and the underside of the lower reach 2*a* so that the tobacco stream 16 is attracted to the lower reach 2*a* all the way from the upstream region Z1 of the stream building zone Z to the discharge end 21 of the conveyor 2. As shown in FIG. 1, the suction chamber 9 has a first portion upstream and a second portion downstream of the surplus removing or trimming device 19, and each of these portions is connected with the intake of the suction generating device 11.

FIGS. 2A–2D show the configuration and distribution of suction chambers 9 and 17 in the upper portion 8 of the tobacco channel 6. The lower reach 2*a* of the conveyor 2 is guided in such a way that it comprises a median or middle section M flanked by two lateral or marginal sections S. The median section M shapes the topmost portion of the growing stream and thereupon the fully grown stream 16 in the channel 6, and the lateral sections S flank the sides of the growing stream and the sides of the fully grown stream 16 so that the upper half at least of the stream has a substantially semicircular outline which corresponds to the preferred outline of the corresponding half of the rod-shaped filler in a continuous cigarette rod. The width of the suction chamber 9 can but need not be constant, and this chamber preferably extends substantially along the full length of the lower reach 2*a* of the conveyor 2 but is interrupted at the surplus removing station which accommodates the trimming device 19. The width of each of the two portions of the suction chamber 9 is selected in such a way that this chamber can attract fibrous material of the stream 16 only to the median section M of the lower reach 2*a*. The suction chambers 17 begin in the second or downstream region Z2 of the stream building zone Z and serve to attract particles of fibrous material to the inner sides of the respective lateral sections S of the lower reach 2*a*. The suction chambers 17 are preferably connected to the intake of the suction generating device 11 but it is equally possible to connect the chambers 17 with a discrete suction generating device. The suction chambers 17 preferably extend from the downstream end of the first region Z1 and all the way, or nearly all the way, to the discharging end 21 of the conveyor 2. The width of the lateral sections S of the lower reach 2*a* preferably increases in the direction (arrow 12) of advancement of the stream 16 toward the wrapping mechanism 22. This can be seen in FIG. 3 which shows the stream building and surplus removing stations in a developed view from below. The arrangement is such that the entire lower reach 2*a* (across its full width) attracts the tobacco stream 16 not later than at the downstream end of the second region Z2 of the stream building zone Z. The stream 16 is attracted by the median section M as well as by the lateral sections S all the way from the stream building zone Z to the discharge end 21 of the conveyor 2. This can be seen by looking at FIGS. 2A–2D and by simultaneously observing the section lines A—A, B—B, C—C and D—D of FIG. 1.

The suction openings or ports 18 in the channel wall 7 are not drawn to scale. They are merely intended to show that the extent to which the fibrous material is attracted to the lower reach 2*a* in the upstream region Z1 of the stream building zone Z is greater than the extent to which the stream is attracted to the median section M in the region Z2 of the stream building zone. Furthermore, FIG. 3 shows that the extent to which the marginal or lateral sections S attract the fibrous material increases or can increase gradually or substantially gradually downstream of the first region Z1 of the stream building zone Z. No attraction to the marginal or lateral sections S takes place in the region Z1. This is desirable and advantageous because it ensures that shower of fibrous material which rises in the region Z1 will invariably reach the median section M and cannot be intercepted by the adjacent portions of the lateral sections S. Consequently, the apparatus can build a stream which is homogeneous in each and every zone thereof. Suction along the median section M decreases in the region Z2 and downstream of the stream building zone Z but it should suffice to prevent the fully grown stream 16 from descending below the lower reach 2*a*. The provision of gradually increasing openings 18 in the bottom wall 7 in the region Z2 downstream of the region Z1 adjacent the lateral sections S ensures that the lateral sections S can attract adequate quantities of fibrous material which rises in the duct 13 to form a stream 16 having a required density across its full cross section.

FIG. 3 further shows that the width of those portions of the bottom wall 7 which is provided with openings or ports 18 located behind the lateral sections S increases gradually in a direction downstream from the region Z1 of the stream building zone Z so as to ensure a gradual widening of the growing stream in the zone Z.

The distribution of suction ports 18 can be modified in a number of ways without departing from the spirit of the invention. For example, the width of that portion of the bottom wall 7 which is adjacent the median section M and has suction ports 18 can decrease in the direction of the arrow 12, and the width of the bottom wall portions which are adjacent the lateral sections S can increase in the opposite direction (counter to the direction which is indicated by the arrow 12). Furthermore, the width of the regions which are provided with ports 18 can be altered at a rate different from that shown in FIG. 3.

As mentioned above, the aforediscussed distribution of suction chambers 9, 17 and of suction ports 18 in the bottom wall 7 of the channel 6, combined with the configuration of the surfaces bounding the path for the stream 16, ensures a gradual growth of a tobacco stream 16 which is homogeneous throughout its entire cross section and which carries the required surplus 16*a* to the station for the trimming device 19. The stream 16 is homogeneous in each and every zone so that it can be converted into a highly satisfactory rod-like filler. Application of suction to the lateral sections S of the lower reach 2*a* in the upstream region Z1 of the stream building zone Z could result in the development of cavities in that portion of the stream 16 which is adjacent the median section M of the conveyor 2. The feature that at least a portion of the stream 16 has an outline resembling or matching the desired outline of the corresponding portion of the rod-like filler is desirable and advantageous because this reduces friction during introduction of successive increments of the trimmed stream 16 into the wrapping mechanism 22. A reduction of the combined cross-sectional area of suction ports 18 behind the median section M of the lower reach 2*a* in the downstream region Z2 of the stream building zone Z is desirable because it greatly enhances the homogeneousness of the fully grown stream 16. This will be readily appreciated by bearing in mind that the stream portion which is adjacent the median section M can be properly densified during formation in the upstream region Z1 so that, once such portion of the stream 16 reaches the region Z2, it is merely necessary to attract it to the median section M while the adjacent portions of the stream 16 grow as a result of progressively increasing attraction of fibers to the lateral sections S.

The wrapping mechanism 22 (also called sizing part) comprises a tongue 26 which is disposed above the path of advancement of the trimmed stream. The web 23 of wrapping material is supplied in the direction of the arrow 23*a* and can be paid out by a suitable bobbin or reel (not shown). The pulley 23A for the web 23 can have a circumferential groove so as to convert the (flat) web 23 into a trough-shaped body having a concave upper side conforming to the desired convex underside of the adjacent portion of the trimmed stream. The web 23 is supplied onto the upper reach of a so-called garniture tape 24 which is trained over a pulley 24A and advances the web 23 and successive increments of the trimmed stream 16 into and through the wrapping mechanism 22. The pulley 24A for the garniture tape 24 can have a circumferential groove so as to impart to successive increments of the tape 24 a concavo-convex shape. The garniture tape 24 accepts successive increments of the trimmed stream 16 at the discharge end 21 of the conveyor 2. The deforming forces which must be applied by the wrapping mechanism 22 can be considerably reduced in view of the aforediscussed configuration of the bottom wall 7 of the channel 6, i.e., in view of shaping of the stream 16 in advance at that side of the stream which contacts the median section M of the lower reach 2*a* of the conveyor 2.

The surplus removing or trimming device 19 comprises two rotary disc shaped knives or cutters 28 whose peripheral surfaces contact each other in the central vertical symmetry plane N (see FIG. 4) of the path for the stream 16. The means for driving the shafts 28A of the knives 28 are not specifically shown in the drawing. Such driving means are disclosed in numerous U.S. patents of the assignee. FIGS. 1 and 3 show that the knives 28 rotate about parallel vertical axes. This means that the underside of the trimmed stream 16 is substantially flat.

In order to ensure that the underside of the trimmed stream 16 conform more closely to the desired outline of the corresponding portion of the filler in the cigarette rod, the trimming device of FIGS. 1 and 3 can be replaced with a modified trimming device 19 which is shown in FIG. 4. The cutters or knives **28*a* of this trimming device constitute discs which are inclined at an angle to the horizontal and the peripheral surfaces of which touch each other in the symmetry plane N. This ensures that the trimmed stream 16 exhibits a substantially roof-shaped underside which more closely resembles the desired outline of the respective portion of the filler in the cigarette rod. FIG. 4 merely shows the knives 28*a*, the associated drive shafts 28A, a portion of the channel 6, and the lower reach 2*a* in a condition which the lower reach assumes due to the configuration of the bottom wall 7 and sidewalls 6*a* of the channel 6 during travel along the suction chamber 9**.

Figure 2A:
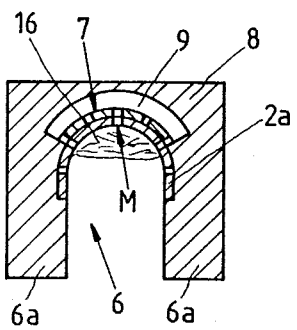
FIG. 2A is a sectional view taken along the line A—A of FIG. 1.
Figure 2B:
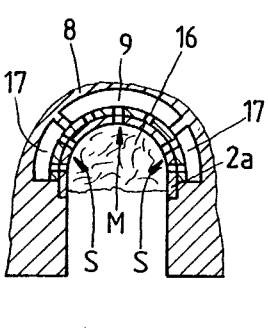
FIG. 2B is a sectional view taken along the line B—B of FIG. 1.
Figure 2C:
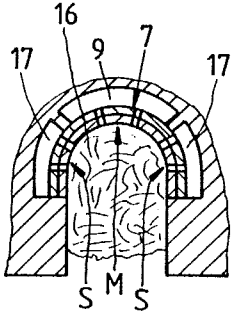
FIG. 2C is a sectional view taken along the line C—C of FIG. 1.
Figure 2D:
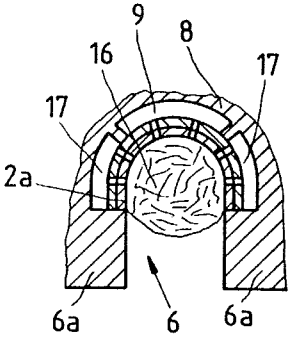
FIG. 2D is a sectional view taken along the line D—D of FIG. 1.

FIG. 5 shows a modified trimming device 19 wherein the disc-shaped cutters or knives **28*b* rotate about parallel vertical axes and their peripheral surfaces contact each other at 29 in the central symmetry plane of the path for the tobacco stream 16. The surplus 16*a* which is removed by the knives 28*b* is returned into the distributor including the duct 13 of FIG. 1. Those portions of the knives 28*b* which are adjacent the peripheral surfaces 29 are grooved, as at 31, so that they are bounded by circumferentially extending concave surfaces enabling the knives 28*b* to mechanically shape the adjacent portion of the stream 16 in order to ensure that such portion of the stream more closely resembles the optimum or desired shape of the corresponding portion of the filler in the cigarette rod. The trimming device 19 of FIG. 5 even further reduces the amount of deforming work which must be carried out by the wrapping mechanism 22 during draping of the trimmed stream 16 into a web of cigarette paper 23 or the like. FIG. 2D shows the outline of the lower portion of the trimmed stream 16 as it appears downstream of the trimming device 19 of FIG. 5**.

FIG. 6 shows a further trimming device wherein the concave surfaces bounded the grooves 31 of the knives **28*b* shown in FIG. 5 are replaced by frustoconical surfaces 32 provided on the disc-shaped cutters or knives 28*c*. The shaping action of the knives 28*c* is analogous to that of the knives 28*a* shown in FIG. 4**.

The utilization of trimming devices of the type shown in FIGS. 4, 5 and 6 is optional but desirable and advantageous. As described in connection with FIGS. 1 and 3, the trimming cutters or knives 28 can be disposed in a common horizontal plane so as to remove the surplus **16*a* in such a way that the underside of the trimmed stream is flat or nearly flat. If such a trimming device is used, the improved apparatus relies for a reduction of friction at the inlet of the wrapping mechanism 22 exclusively or primarily upon the shaping of the stream 16 under the action of the U-shaped lower reach 2*a* of the air-permeable conveyor 2. The provision of grooved pulleys 23A and/or 24A also constitutes an optional feature of the improved apparatus. Initial shaping of the web 23 is desirable on the ground that this contributes to a reduction of friction during entry of successive increments of the web 23 into the wrapping mechanism 22 and thus reduces the likelihood of wrinkling, folding and/or other undesirable deformation of the web during draping around the trimmed tobacco stream 16**.

Figure 7:
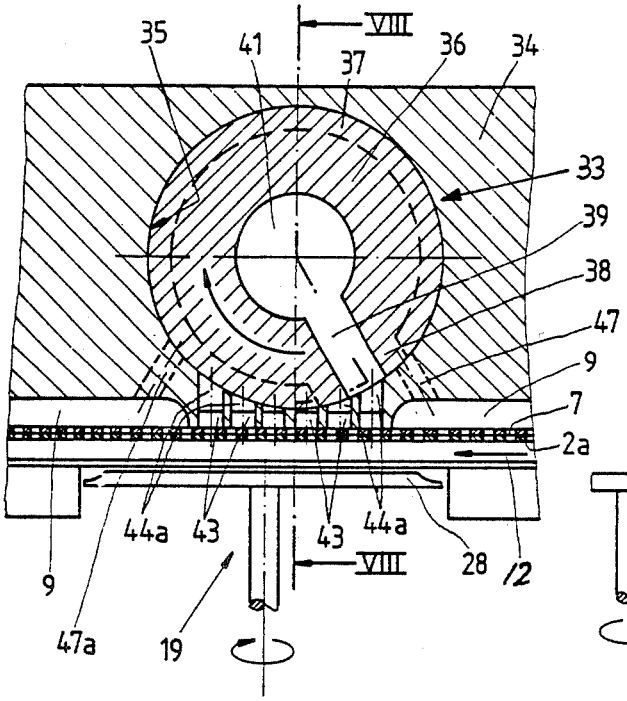
FIG. 7 is an enlarged vertical sectional view of the densifying unit at the surplus removing station of the apparatus which is shown in FIG. 1.
Figure 8:
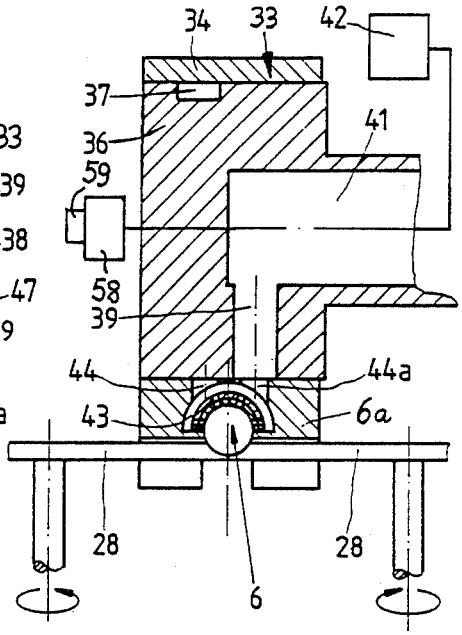
FIG. 8 is a sectional view as seen in the direction of arrows from the line VIII—VIII of FIG. 7.
Figure 9:
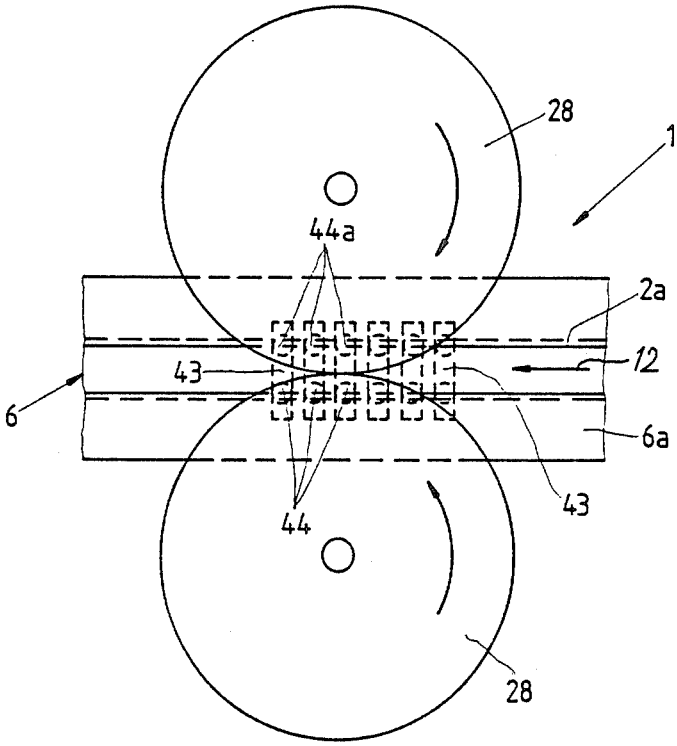
FIG. 9 is a bottom plan view of the structure which is shown in FIG. 7.

As stated before, the suction chamber 9 is interrupted at the surplus removing station which accommodates the trimming device 19. This renders it possible to install a densifying device or unit 33 which embodies one form of the present invention and the details of which are shown in FIGS. 7, 8 and 9. The densifying device 33 comprises a stationary housing 34 which can be attached to the frame of the cigarette rod making machine and defines a chamber 35 for a rotary control member 36 which is a valving element and constitutes a means for periodically varying the pressure differential between the upper side and the underside of the lower reach **2*a* of the conveyor 2 at the surplus removing station. This ensures that the machine which embodies the apparatus of FIGS. 1–9** can turn out cigarettes with dense ends.

The peripheral surface of the valving element 37 travels along and is in sealing contact with the surface surrounding the chamber 35 in the housing 34. As best shown in FIG. 8, the peripheral surface of the valving element 36 has a circumferentially extending groove 37 which is interrupted at 38. The groove 37 is disposed in a first plane extending at right angles to the axis of rotation of the valving element 36. The latter is provided with a radially extending bore or suction port 39 which is disposed in a second plane, also extending at right angles to the axis of rotation of the valving element 36, and communicates with an axially extending bore 41 leading to the intake of a suction generating device 42. The bore 39 is disposed in that region (at 38) where the circumferentially extending groove 37 of the valving element 36 is interrupted. Suction which is generated by the device 42 is more pronounced than the suction in the chamber 9, i.e., than the suction which is generated by the device 11. For example, suction in the chamber 9 and in the device 11 can be in the range of 800 mm water column or 80 mbar, whereas the suction in the bore 39 and in the device 42 can be approximately 3000 mm water column or 0.3 bar. Such suction can be readily generated by a conventional lateral-channel compressor.

The top portion 8 of the channel 6 is provided with a plurality of transversely extending suction chambers 43 which are disposed above the surplus removing station, one after the other, as considered in the direction of arrow 12. Each suction chamber 43 communicates with a first passage 44 and with a second passage **44*a* of the channel 6. Each pair of cooperating passages 44, 44*a* is disposed in a plane extending transversely of the direction (arrow 12) of advancement of the stream 16 toward, past and beyond the trimming device 19. The passages 44 and 44*a* extend from the respective suction chambers 43 to the chamber 35 of the housing 34. The suction chambers 43 are machined into the underside of the housing 34 (i.e., into the underside of the bottom wall 7 of the channel 6) at the surplus removing station. Their distribution can be seen in FIG. 9** which shows the surplus removing station from below.

The passages 44 are located in the plane of the groove 37 in the element 36 and passages 44a are located in the plane of the orbiting bore 39 of the valving element 36. The housing 34 is further provided with a bore 47 which connects the upstream portion of the suction chamber 9 with the chamber 35 and a bore 47a which connects the downstream portion of the chamber 9 with the chamber 35. The bores 47 and 47a are located in the plane of the groove 37 in the periphery of the valving element 36.

The peripheral speed of the valving element 36 can match or very closely approximate the speed of lengthwise movement of the lower reach 2a of the conveyor 2.

The operation of the densifying device 33 is as follows:

During the larger or longer first stage of each revolution of the valving element 36, the groove 37 communicates with the passages 44 of the housing 34 so as to connect the suction chamber 9 with the suction chambers 43 whereby the force with which the stream 16 is attracted to the lower reach 2a of the conveyor 2 at the surplus removing station matches the force with which the stream 16 is attracted to those portions of the lower reach 2a which are disposed below the suction chamber 9. This is due to the fact that the two portions of the suction chamber 9 communicate with the chamber 35 by way of the bores 47, 47a which are coplanar with the groove 37.

The portion 38 of the rotating valving element 36 seals the suction chambers 9 from the suction chambers 43 during a relatively short second stage of each revolution of the valving element 36. However, at such time, the bore 39 begins to communicate with successive passages 44a to thereby connect the suction generating device 42 with successive suction chambers 43, as considered in the direction of the arrow 12. Since the suction in the device 42 is more pronounced than in the device 11 and suction chambers 9, the suction chambers 43 bring about a more pronounced densification of the adjacent increments of the advancing stream 16 so that the knives 28 of the trimming device 19 remove less tobacco and the corresponding portion of the filler is densified as a result of passage through the wrapping mechanism 22. It will be seen that the suction chambers 43 can attract the adjacent portions of the stream 16 toward the underside of the lower reach 2a of the conveyor 2. The utilization of a plurality of suction chambers 43 which form a row extending in the direction of the arrow 12 ensures that the densified portion of the stream 16 travels toward the wrapping mechanism 22 and that the cutters 28 cannot remove as much tobacco as when the suction chambers 43 communicate with the suction generating device 11 by way of the two portions of the suction chamber 9, bores 47, 47a, chamber 35 and groove 37.

The leading end of the groove 37 thereupon again reaches the passages 44 and ensures that suction in the chambers 43 drops so that it matches or approximates that in the chamber 9. Accordingly, the adjacent portion of the stream 16 is not densified to the extent which is necessary for the making of dense ends. In other words, less densified portions of the stream 16 alternate with more densified portions. The cigarette rod which issues from the wrapping mechanism 22 is severed by a conventional cutoff, either across or adjacent the densified portions of its filler, depending upon whether each plain cigarette is to be provided with one or two dense ends.

An important advantage of the densifying device 33 is that it can be fixedly mounted in the improved apparatus. Furthermore, the operation of the densifying device 33 is independent of the selected format. By properly selecting the peripheral speed of the valving element 36, the machine can turn out shorter or longer cigarettes with dense ends.

Another important advantage of the densifying device 33 is that the stream 16 is very unlikely to move axially relative to the conveyor 2 an/or channel 6. This is due to the fact that each and every portion of the stream 16 is properly attracted to the conveyor 2, also at the surplus removing station.

An additional important advantage of the improved densifying device 33 is its compactness. Furthermore, it is not necessary to alter, or to appreciably alter, the adjacent components of the stream forming apparatus and/or of the rod making machine. The operation of the machine is especially reliable if the peripheral speed of the valving element 36 matches the speed of the lower reach 2a of the conveyor 2.

The feature that the conveyor 2 and/or the trimming device 19 shapes the stream 16 ahead of the wrapping mechanism 22 is desirable and advantageous because this ensures the making of a superior filler which is homogeneous across its full cross section. Moreover, this further reduces the likelihood of slippage of the stream 16 relative to the conveyor 2. The absence of slippage is particularly important in view of the provision of means for densifying selected portions of the stream 16. It will be readily appreciated that even minor shifting of the trimmed stream relative to the conveyor 2 could result in severing of the cigarette rod across non-densified portions of the filler.

An additional important advantage of the improved apparatus is that it is not necessary to replace any parts if the operators desire to make shorter or longer cigarettes. All that is necessary is to change the velocity ratio of the valving element 36 and conveyor 2. Moreover, the fibers of the stream which is densified at selected intervals are treated gently so that the fibers are not comminuted and the filler contains a relatively low percentage of shorts. The utilization of a tobacco channel which converts the normally flat lower reach 2a of the conveyor 2 into a substantially U-shaped body contributes significantly to elimination or reduction of slippage between the stream 16 and the conveyor 2. This will be readily appreciated since the stream 16 is contacted by the conveyor 2 not only at the top but also at the sides.

As a rule, or in many instances, the peripheral speed of the valving element 36 will be selected in such a way that it matches or closely approximates the speed of the stream 16 and of the lower reach 2a of the conveyor 2. In order to avoid the need for replacement of the disc 36 with a different disc if and when the operators decide to make longer or shorter cigarettes, it is also contemplated to alter the peripheral speed of the valving element 36 with reference to the speed of the stream 16. This is desirable because it is not necessary to maintain a supply of spare valving elements 36 each of which has a groove 37 of different length and a differently dimensioned radial bore 39. FIG. 8 shows schematically a drive 58 which serves to rotate the valving element 36 about a substantially horizontal axis. The arrangement is such that the peripheral speed of the valving element 36 varies periodically in dependency on its angular position so that the bore 39 travels in synchronism with the stream 16 when it communicates with the passages 44*a*. When the outer end of the bore 39 advances beyond the leftmost passage 44*a* of FIG. 9, the speed of the valving element 36 is increased or reduced, depending upon the desired spacing between successive densified portions in the stream 16. FIG. 8 further shows a monitoring device 59 which is available on the market and serves to regulate the speed of the motor 58 in dependency on the angular position of the bore 39, i.e. upon the desired spacing between successive densified portions of the stream 16. The drive means 58 can constitute a discrete motor or a transmission which receives motion from the main prime mover of the cigarette rod making machines. The manner of regulating the speed of a rotary element during several stages of each of its revolutions is well known in the art. Reference may be had, for example to commonly owned U.S. Pat. Nos. 4,201,102 and 4,255,998 to Rudszinat. The patents to Rudszinat disclose a suitable speed regulating system for a different purpose, namely to regulate the speed of a transverse cutter or cross cutter for sheets of paper or the like.

Figure 11:
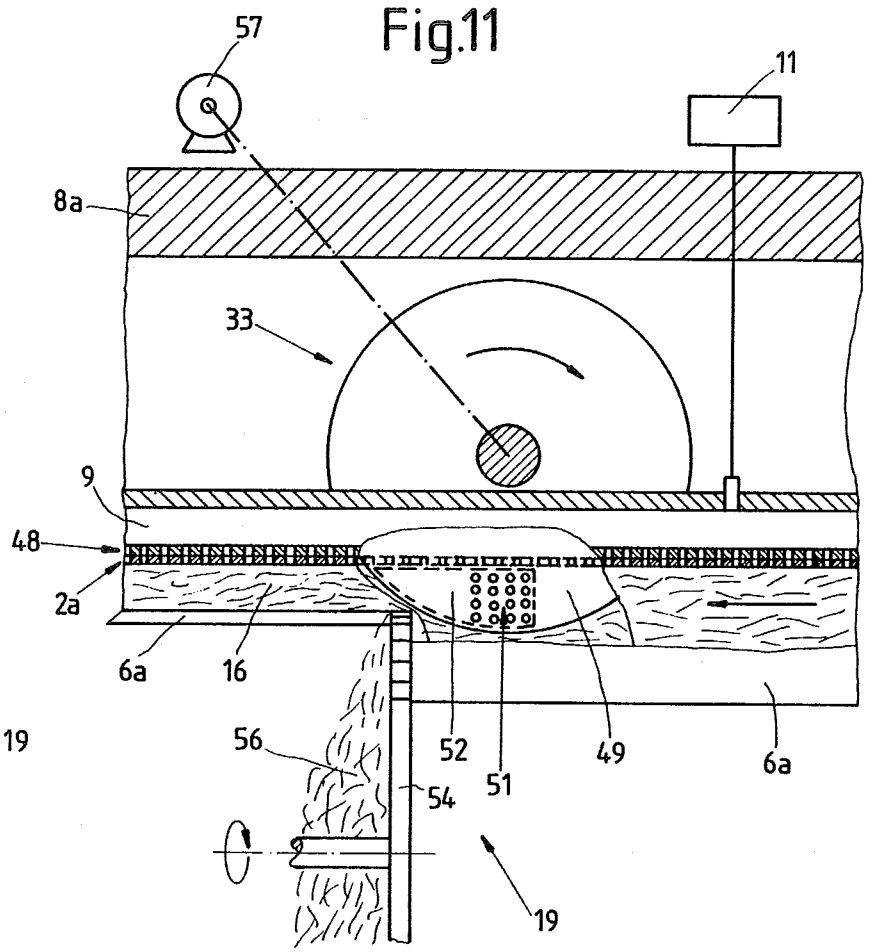
FIG. 11 is a sectional view a seen in the direction of arrows from the line XI—XI of FIG. 10.
Figure 10:
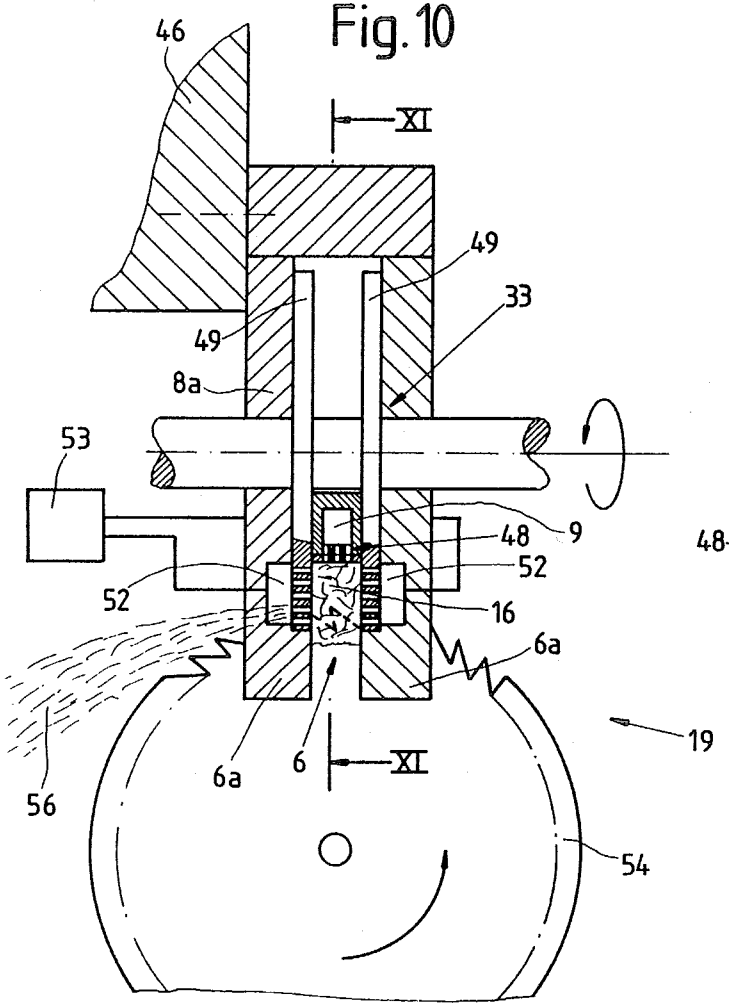
FIG. 10 is a transverse vertical sectional view of an apparatus which embodies a modified densifying unit.

FIGS. 10 and 11 show a modified densifying device 33 wherein all such parts which are identical with or clearly analogous to the corresponding parts of the densifying device of FIGS. 7 to 9 are denoted by similar reference characters. The upper portion 8*a* of a slightly modified channel 6 is separably secured to the frame 46 of the cigarette rod making machine. The sidewalls 6*a* of the channel 6 define a groove which terminates at the flat perforated bottom wall 48 of the channel and receives the lower reach 2*a* of the endless air-permeable conveyor. The suction chamber 9 is disposed at a level above the flat bottom wall 48 and is connected with a suction generating device 11. The conveyor 2 can constitute a textile band or a metallic band having suitably distributed holes or perforations. The surplus removing device 19 comprises a continuously driven material removing tool 54 which resembles a milling cutter and removes the surplus 56 transversely of the direction of advancement of the trimmed stream 16.

The valve means of the densifying device 33 comprises two rotary valving elements in the form of discs 49 provided in the respective sidewalls 6*a* and having selected portions provided with openings or perforations 51 (see particularly FIG. 11). The lower portions of the valving elements 49 are adjacent to discrete suction chambers 52 which are machined into the respective sidewalls 6*a* and are connected to the intake of a suction generating device 53 wherein the suction is more pronounced than in suction chamber 9. The arrangement is such that the perforations 51 of the valving elements 49 communicate with the respective suction chambers during a particular relatively short stage of each revolution of the valving elements. At such time, the suction chambers 52 communicate with that portion of the path for the stream 16 which is disposed at the surplus removing station accommodating the trimming device 19. The suction generating device 53 can be omitted if the suction chambers 52 are connected directly with the suction chamber 9 or with the suction generating device 11. The orientation of perforations 51 in the selected portions of the valving elements 49 is preferably such that the currents of air which flow into the perforations 51 while the perforations register with the corresponding suction chambers 52 cause the adjacent portions of the stream 16 to have a component of movement toward the underside of the lower reach 2*a* of the conveyor 2. In other words, the suction chambers 52 can cause the stream 16 to undergo compression in a direction toward the underside of the lower reach 2*a* and/or toward the respective sidewalls 6*a*. This entails a pronounced and desirable intermittent densification of the stream 16 so that the tool 54 at times removes smaller quantities of surplus 56 and the filler of the cigarette rod is formed with densified portions which are thereupon severed or are located adjacent to the severing planes, depending upon whether the cigarettes should be provided with one or two dense ends. The inclination of perforations 51 with reference to the horizontal can be much more pronounced than shown in FIG. 10.

The drive means for the valving elements 49 (which can be said to constitute mobile portions of the respective sidewalls 6*a*) comprises a motor 57 which is shown in the upper left-hand portion of FIG. 11. The motor 57 can be replaced by a transmission which receives motion from the main prime mover of the cigarette rod making machine embodying the structure of FIGS. 10 and 11.

The construction of the motor 57 or of the just discussed transmission can be such that the peripheral speed of the valving elements 49 varies during each revolution. For example, the arrangement can be such that the speed of the perforations 51, while they register with the respective suction chambers 52, equals or closely approximates the speed of the stream 16 and of the lower reach 2*a* of the conveyor 2. The speed of the valving elements 49 is thereupon increased so as to correspond to or to be proportional with the increase of that component of movement of the perforations 51 which is directed toward the underside of the lower reach 2*a*. This ensures that the currents of air flowing through the perforations 51 and into the suction chambers 52 do not interfere with the desired rate of forward movement of the stream 16.

The densifying device 33 of FIGS. 10–11 is particularly advantageous when the lower reach 2*a* of the conveyor 2 is flat or nearly flat.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for making a continuous stream from fibrous material of the tobacco processing industry, comprising an endless air-permeable conveyor defining an elongated path, said conveyor having a first side adjacent said path and a second side; means for feeding fibrous material into a first portion of said path so as to build a continuous stream which contains a surplus of fibrous material and advances along said path; means for removing the surplus from the stream in a second portion of said path downstream of said first portion; and means for pneumatically densifying spaced-apart portions fo the stream in the region of said surplus removing means, including means for establishing a variable pressure differential between said sides of said conveyor so as to attract the stream to said first side and to densify the stream in said path, said densifying means further including means for periodically varying said pressure differential so as to change the extent of densification of the stream in said region.

2. The apparatus of claim 1, wherein said varying means comprises a control member arranged to periodically increase the pressure differential at least in the second portion of said path.

3. The apparatus of claim 1, wherein said establishing means includes at least one suction chamber adjacent the second side of said conveyor, a first suction generating device arranged to maintain the pressure in said chamber at a first value and a second suction generating device arranged to maintain the pressure in said chamber at a lower second value, said varying means including means for alternately connecting said suction chamber with said first and second suction generating devices 4. The apparatus of claim 3, wherein said suction chamber is adjacent said second portion of said path and further comprising a second suction chamber connected to said first suction generating device and including first and second portions adjacent the second side of said conveyor and respectively disposed upstream and downstream of the second portion of said path.

5. The apparatus of claim 4, wherein said varying means includes means for alternately connecting said at least one suction chamber with said second chamber and with said second suction generating device.

6. The apparatus of claim 5, wherein said establishing means comprises a plurality of suction chambers adjacent the second side of said conveyor in the region of the second portion of said path.

7. The apparatus of claim 6, wherein said densifying means further comprises a housing for said varying means and for said plurality of suction chambers, said housing having a pair of passages for each of said plurality of suction chambers and said varying means comprising a valving element rotatably mounted in said housing and having means for connecting said second suction chamber with one passage of each pair of passages during a first stage of each of its revolutions and means for connecting said second suction generating device with the other passage of each pair of passages during a second stage of each revolution of said valving element.

8. The apparatus of claim 7, wherein said valving element has a circumferentially extending groove which connects one passage of each pair of passages with said second suction chamber during said first stage of each revolution of said valving element and a substantially radially extending bore which connects said second suction generating device with the other passages of said pairs of passages during the second stage of each revolution of said valving element.

9. The apparatus of claim 7, further comprising means for driving said conveyor and said valving element so that the peripheral speed of the valving element equals or approximates the speed of the conveyor.

10. The apparatus of claim 1, further comprising a channel for said conveyor, said channel having a substantially U-shaped cross-sectional outline along a portion at least of said path.

11. Apparatus for making a continuous stream from fibrous material of the tobacco processing industry, comprising an endless conveyor defining an elongated path; means for feeding fibrous material into a first portion of said path so as to build a continuous stream which contains a surplus of fibrous material and advances along said path; means for removing the surplus from the stream in a second portion of said path downstream of said first portion; means for pneumatically densifying spaced-apart portions of the stream in the region of said surplus removing means; and a channel for said conveyor, said channel having sidewalls flanking said second portion of said path and said densifying means comprsing a suction chamber provided in at least one of said sidewalls and mobile valve means provided in said one sidewall and arranged to intermittently connect said suction chamber with the second portion of said path so as to effect a densification of the stream in said second portion of the path by air which flows into said suction chamber.

12. The apparatus of claim 11, wherein said valve means has openings which are oriented in such a way that currents of air flowing from said second portion of said path into said suction chamber urge the stream in said second portion of said path to bear upon said endless conveyor while the stream advances with said conveyor.

13. The apparatus of claim 12, wherein said valve means includes a rotor and said openings are disposed in a predetermined portion of said rotor.

14. The apparatus of claim 13, wherein each of said sidewalls has a suction chamber and each of said sidewalls is provided with mobile valve means.

15. Apparatus for making a continuous stream from fibrous material of the tobacco processing industry, comprising an endless air-permeable conveyor defining an elongated path; means for feeding fibrous material into a first portion of said path so as to build a continuous stream which contains a surplus of fibrous material and advances along said path; means for removing the surplus from the stream in a second portion of said path downstream of said first portion; means for pneumatically densifying spaced-apart portions of the stream in the region of said surplus removing means; means for converting the stream into a rod-like filler having a predetermined outline in a third portion of said path, said conveyor including a median section having an outline which is substantially complementary to a portion of said predetermined outline and two lateral sections flanking said median section; and means for attracting fibrous material to said conveyor in the first portion of said path including means for attracting fibrous material to said median section in a first region of said first portion and means for attracting fibrous material to said median section and to said lateral sections in a second region of said first portion downstream of said first region.

16. Apparatus for making a continuous stream from fibrous material of the tobacco processing industry, comprising an endless conveyor defining an elongated path; means for feeding fibrous material into a first portion of said path so as to build a continuous stream which contains a surplus of fibrous material and advances along said path; means for removing the surplus from the stream in a second portion of said path downstream of said first portion; means for pneumatically densifying spaced-apart portions of the stream in the region of said surplus removing means; and means for converting the stream into a rod-like filler having a predetermined outline in a third portion of said path, said surplus removing means including means for imparting to a portion of the stream an outline at least approximating a portion of said predetermined outline.

17. Apparatus for making a continuous stream from fibrous material of the tobacco processing industry, comprising an endless conveyor defining an elongated path; means for feeding fibrous material into a first portion of said path so as to build a continuous stream which contains a surplus of fibrous material and advances along said path; means for removing the surplus from the stream in a second portion of said path downstream of said first portion; means for pneumatically densifying spaced-apart portions of the stream in the region of said surplus removing means; and a channel for said conveyor, said channel having a substantially U-shaped cross-sectional outline along a portion at least of said path.

18. The apparatus of claim 17, wherein said conveyor is permeable to air and has a first side adjacent said path and a second side, said densifying means including means for establishing a variable pressure differential between said sides of the conveyor so as to attract the stream to said first side and to densify the stream in said path, and means for periodically varying said pressure differential so as to change the extent of densification of the stream in said region.

19. The apparatus of claim 17, further comprising means for converting the stream into a rod-like filler having a predetermined outline in a third portion of said path, said conveyor being permeable to air and including a median section having an outline which is substantially complementary to a portion of said predetermined outline and two lateral sections flanking said median section, and means for attracting fibrous material to said conveyor in the first portion of said path including means for attracting fribrous material to said median section in a first region of said first portion and means for attracting fibrous material to said median section and to said lateral sections in a second region of said first portion downstream of said first region.

20. The apparatus of claim 17, further comprising means for converting the stream into a rod-like filler having a predetermined outline in a third portion of said path, said surplus removing means including means for imparting to a portion of the stream an outline at least approximating a portion of said predetermined outline.

21. The apparatus of claim 17, wherein said densifying means comprises at least one rotary element and further comprising means for rotating said element at different speeds during predetermined stages of each revolution of said element.

22. The apparatus of claim 17, wherein said densifying means includes means for urging the stream against the conveyor in said second portion of said path.

23. The apparatus of claim 22, wherein said urging means comprises at least one stationary suction chamber adjacent the second portion of said path and at least one orbiting suction port arranged to periodically connect the suction chamber with the second portion of said path.

24. Apparatus for making a continuous stream of fibrous material of the tobacco processing industry, comprising an endless conveyor defining an elongated path; means for feeding fibrous material into a first portion of said path so as to build a continuous stream which contains a surplus of fibrous material and advances along said path; means for removing the surplus from the stream in a second portion of said path downstream of said first portion; means for pneumatically densifying spaced-apart portions of the stream in the region of said surplus removing means, comprising at least one rotary element; and means for rotating said element at different speeds during predetermined stages of each revolution of said element.

25. Apparatus for making a continuous stream of fibrous material of the tobacco processing industry, comprising an endless conveyor defining an elongated path; means for feeding fibrous material into a first portion of said path so as to build a continous stream which contains a surplus of fibrous material and advances along said path; means for removing the surplus from the stream in a second portion of said path downstream of said first portion; and means for pneumatically densifying spaced-apart portions of the stream in the region of said surplus removing means, including means for urging the stream against the conveyor in said second portion of said path, said urging means comprising at least one stationary suction chamber adjacent the second portion of said path and at least one orbiting suction port arranged to periodically connect the suction chamber with the second portion of said path.

* * * * *